US007039552B2

(12) United States Patent
Zhang et al.

(10) Patent No.: US 7,039,552 B2
(45) Date of Patent: May 2, 2006

(54) METHOD AND ONLINE SYSTEM FOR MONITORING CONTINUOUS CASTER START-UP OPERATION AND PREDICTING START CAST BREAKOUTS

(75) Inventors: Yale Zhang, Dundas (CA); Vit Vaculik, Hamilton (CA); Ivan Miletic, Hamilton (CA); Michael S. Dudzic, Ancaster (CA)

(73) Assignee: Dofasco Inc., Hamilton (CA)

( * ) Notice: Subject to any disclaimer, the term of this patent is extended or adjusted under 35 U.S.C. 154(b) by 136 days.

(21) Appl. No.: 10/718,636

(22) Filed: Nov. 24, 2003

(65) Prior Publication Data

US 2004/0172153 A1 Sep. 2, 2004

(30) Foreign Application Priority Data

Dec. 12, 2002 (CA) ..... 2414167

(51) Int. Cl.
*G06F 19/00* (2006.01)

(52) U.S. Cl. ..... 702/182
(58) Field of Classification Search ..... 702/182; 700/146; 351/246; 436/171, 66; 435/287; 800/278; 386/39; 382/111; 280/326; 455/423; 154/452; 345/619
See application file for complete search history.

(56) References Cited

U.S. PATENT DOCUMENTS 3,478,808 A 11/1969 Adams
4,235,276 A 11/1980 Giles et al.

(Continued)

FOREIGN PATENT DOCUMENTS

EP 0 389 139 9/1990

(Continued)

OTHER PUBLICATIONS

Dudzic et al; IFAC Futur Trends in Met. Proc. 2000.

(Continued)

*Primary Examiner*—John Barlow
*Assistant Examiner*—Tung S. Lau
(74) *Attorney, Agent, or Firm*—Ingrid E. Schmidt

(57) ABSTRACT

A new start-up operation of a continuous caster is monitored by comparing itself with the normal start-up operation, which is benchmarked by a multivariate statistical model using selected historical operation data. If the new operation is statistically different from the benchmark, then alarms are generated to indicate an impending start cast breakout and at the same time, the process variables that lead to process excursions from the normal operation are identified as the most likely root causes of the predicted breakout. The model is built using Mult-way Principal Component Analysis technology to characterize the operation-to-operation variance in a reduced dimensional space (also known as latent variable space) based on a large number of process trajectories from past normal start-up operations. The process trajectories over the entire start cast duration are predicted based on the current observations. They are then synchronized by interpolating themselves based on pre-specified non-uniform synchronization scales in the strand length such that all trajectories can be aligned with respect to the strand length for further use in model development.

27 Claims, 14 Drawing Sheets

U.S. PATENT DOCUMENTS

| | | | | |
|---|---|---|---|---|
| 4,949,777 | A | 8/1990 | Itoyama et al. | |
| 5,257,206 | A | 10/1993 | Hanson | |
| 5,359,531 | A | 10/1994 | Iwamoto et al. | |
| 5,548,520 | A | 8/1996 | Nakamura et al. | |
| 5,904,202 | A | 5/1999 | Adamy | |
| 5,949,678 | A | 9/1999 | Wold et al. | |
| 6,179,041 | B1 | 1/2001 | Pleschiutschnigg | |
| 6,212,438 | B1 | 4/2001 | Reine | |
| 6,564,119 | B1 * | 5/2003 | Vaculik et al. | 700/146 |

FOREIGN PATENT DOCUMENTS

| | | |
|---|---|---|
| WO | WO 00/05013 | 2/2000 |

OTHER PUBLICATIONS

European Search Report Dated Mar. 3, 2004 EPO Form 1503 03.82.

Dudzic M etal: Multivariate Sta0tistical Monitoring of a Continuous Steel Slab Caster, Jun. 10, 2002.

Proceedings of the 2002 American Control Conference. ACC. Anchorage, Al, May 8, 10, 2002; American Control Conference, New York, NY: IEEE, US, vol. 1 of 6 May 8, 2002 pp. 600-601, XP010597174.

Technometrics, Feb. 1995, vol. 37, No 1 pp. 41-59; AlChE Journal Aug. 1994 vol. 40, No 8 pp. 1361 to 1375; Chemometrics and Intelligent Laboratory Systems 35 (1996) 45-65; J. Proc. Cont. vol. 5, No 4, pp. 277-284, 1995.

* cited by examiner

METHOD AND ONLINE SYSTEM FOR MONITORING CONTINUOUS CASTER START-UP OPERATION AND PREDICTING START CAST BREAKOUTS

TECHNICAL FIELD

The present invention relates generally to a continuous casting process, and more particularly, to a method and online system of monitoring continuous caster start-up operations to predict breakout events. This system generates alarms to indicate an impending breakout in a caster start-up operation and identifies the process variables as the most likely root causes of the predicted breakout such that appropriate control actions can be taken automatically or manually by operators to reduce the possibility of breakout occurrence.

BACKGROUND ART

Continuous casting, in the steel-making industry, is the key process whereby molten steel is solidified into a semi-finished product such as a billet, bloom, or slab for subsequent rolling in the hot strip mill or the finishing mill. This process is achieved through a well-designed casting machine, known as a continuous caster, or concaster.

FIG. 1 shows a schematic diagram of a continuous caster according to the prior art, which comprises the following key sections: a ladle turret 20, a ladle 22, a tundish 24 with a stopper-rod 26, a submerged entry nozzle (SEN) 28, a water-cooled copper mold 30, a roller containment section with additional cooling chambers 32, a straightener withdrawal unit 34 and a torch severing equipment 36.

Molten steel from an electric or basic oxygen furnace is tapped into a ladle and shipped to the continuous caster. The ladle is placed into the casting position above the tundish 24 by the turret 20. The steel is poured into the tundish 24, and then into the water-cooled copper mold 30 through the SEN 28, which is used to regulate the steel flow rate and provide precise control of the steel level 38 in the mold. As the molten steel moves down the mold 30 at a controlled rate, the outer shell of the steel becomes solidified to produce a steel strand 40. Upon exiting the mold 30, the strand 40 enters a roller containment section and cooling chamber in which the solidifying strand is sprayed with water to promote solidification. Once the strand is fully solidified and has passed through the straightener withdrawal unit 34, it is cut to the required length in the severing unit 36.

The main operational issues in continuous casting processes relate to achieving a stable operation following start-up, and then maintaining stability. A proper start-up operation is very crucial to successfully achieving this goal, which involves appropriate use of a dummy bar, the correct starting lubricant and the applicable sequence of ramping up to the casting speed during the start-up operation.

To start a cast, the mold bottom is sealed by a steel dummy bar, which prevents molten steel from flowing out of the mold. The steel poured into the mold is partially solidified, producing a steel strand with a solid outer shell 42 and a liquid core 44. Once the steel shell has a sufficient thickness, the straightener withdrawal unit withdraws the partially solidified strand out of the mold along with the dummy bar. Molten steel continues to pour into the mold to replenish the withdrawn steel at an equal rate. When the dummy bar head, which is now attached to the solidified strand being cast, reaches a certain position in the withdrawal unit, it is mechanically disconnected and removed.

A well-known problem associated with the continuous caster, is that molten steel is prone to tear in the strand shell and cause a breakout such that molten steel pours out beneath the mold. A breakout may occur either during start-up operation, known as a start cast breakout, or during the following run-time operation, known as a run-time cast breakout. For a typical, fully operational continuous caster, approximately 25% of total breakouts occur during the start-up operation. These breakouts are of major concern in the steel-making industry, because they diminish the reliability and efficiency of the production process, create substantial costs due to production delays and destruction of equipment, and many times, pose significant safety risks to plant operators. Therefore, the ability to prevent breakouts from happening utilizing engineering expertise and analytical methods can provide excellent benefits to the continuous casting process.

Although there have already been some methods and systems developed to detect and/or predict the run-time cast breakouts in the prior art, the start cast breakout and its prevention has received very little attention in both academia and industry. It is important, then, to be able to predict start cast breakouts with sufficient lead-time such that they can be prevented by taking appropriate control actions. One example of these control actions is to change the ramping profile of the casting speed in order to slow down the casting process and provide more time for steel solidification in the mold.

According to the prior art in the area of detecting and/or predicting breakouts in continuous casting processes, there exist two different types of methods. One is the pattern-matching method, for example, the well-known sticker detection method, which develops comprehensive rules to characterize the patterns in the mold temperatures prior to the incidence of a breakout based on past casting operation experiences. If such patterns have been recognized in the current casting operation, then there is a high likelihood that a breakout will occur. The relevant systems based on this type of method are described by Yamamoto et al in U.S. Pat. No. 4,55,099, Blazek et al in U.S. Pat. No. 5,020,585, Nakamura et al in U.S. Pat. No. 5,548,520, and by Adamy in U.S. Pat. No. 5,904,202. The other method is multivariable statistical method described by Vaculik et al in U.S. Pat. No. 6,564,119 where a principal component analysis (PCA) model is built using an extended set of process measurements, beyond the standard mold temperatures, to model the normal operation of casting processes; certain statistics are then calculated by the model to detect exceptions to normal operation in the current casting operation and predict potential breakouts. Both of these methods, however, are focused on detecting and/or predicting the run-time cast breakouts, and will experience some difficulties when they are applied to the start-up operation.

The applicant is also aware of prior art in the use of multivariable statistical technology for batch process monitoring and fault diagnosis in other fields. Examples of methods and industrial applications of monitoring a batch process using multivariate statistical technology are described by MacGregor and his co-workers in AIChE Journal, volume 40, 1994, Journal of Process Control, volume 5, 1995, etc. There is no application of such multivariable statistical technology to continuous caster start-up operations described in the patent literature.

To summarize, methods and online systems for monitoring continuous caster start-up operations and predicting start cast breakouts using multivariable statistical technology have not been addressed to date.

DISCLOSURE OF INVENTION

This invention is an online system for monitoring start-up operations of a continuous caster based on the use of a multivariable statistical model of the type Multi-way Principal Component Analysis (MPCA), and the associated method to develop such a system. The online system is able to predict an impending start cast breakout and identify the process variables as the most likely root causes of the predicted breakout. Additional aspects of the invention deal specifically with start-up process data synchronization, MPCA model development and online system implementation not found in the prior art.

In accordance with this invention, a new start-up operation of a continuous caster is monitored by comparing itself with the normal start-up operation, which is benchmarked by a multivariable statistical model using selected historical operation data. If the new operation is statistically different from the benchmark, then alarms are generated to indicate an impending start cast breakout and at the same time, the process variables that lead to process excursions from the normal operation are identified as the most likely root causes of the predicted breakout. The model is built using MPCA technology to characterize the operation-to-operation variance in a reduced dimensional space (also known as latent variable space) based on a large number of process trajectories from past normal start-up operations. The process trajectories represent the changes of an extended set of process measurements, including the mold temperatures, casting speed, stopper-rod position, calculated heat flux and so forth, in a finite duration of start-up operation. The data in these trajectories exhibit a time-varying and highly autocorrelated structure, and the use of the MPCA technology allows these data to be modeled properly. The prior art based on normal PCA technology could not handle such data and is therefore restricted to be applied to the caster run-time operation.

In this invention, the duration of start-up operation, known as start cast duration, is defined by the strand length, rather than the casting time as usual. The process trajectories over the entire start cast duration are predicted based on the current observations, and are then synchronized by interpolating themselves based on pre-specified non-uniform scales in the strand length such that all trajectories can be aligned with respect to the strand length for further use in model development.

The invention contains an online update component to continuously adjust certain parameters (i.e., control limits) in the MPCA models based on the new start-up operation data. This allows the model to partially adapt itself to drifts from a normal operation region not characterized by the models.

In addition, a state determination function is included in the invention, which is used to determine whether a continuous caster is in a start-up operation or a run-time operation such that both operations can be monitored in an integrated monitoring system.

The invention includes the following aspects that arise solely in the case of model development and online implementations:

- definition of start-cast duration;
- selection of process variables that represent the nature of caster start-up operations;
- prediction of process trajectory in the future observations;
- process trajectory synchronization based on non-uniform synchronization scales in strand length;
- method to identify the process variables as the most likely root cause of the predicted breakout;
- online updating of model parameters;
- ability to determine the process state and monitor both start-up and run-time operation in an online monitoring system.

To summarize, it is the method and online application of the MPCA technology particularly applied to continuous caster start-up operations for monitoring and predicting start cast breakouts, that is both novel and non-obvious.

DESCRIPTION OF DRAWINGS

In order to better understand the invention, a preferred embodiment is described below with reference to the accompanying drawings, in which.

BEST MODE FOR CARRYING OUT THE INVENTION

This invention is an on-line system of monitoring continuous caster start-up operation and predicting start cast breakouts using MPCA technology and the associated method to develop such a system. The system is implemented by a process computer system and can be applied to a variety of continuous casters, which is not limited by their individual design features, such as type of product (i.e., billet, bloom or slab), type of mold (i.e., tubular mold or plate mold) and so forth.

Figure 1:
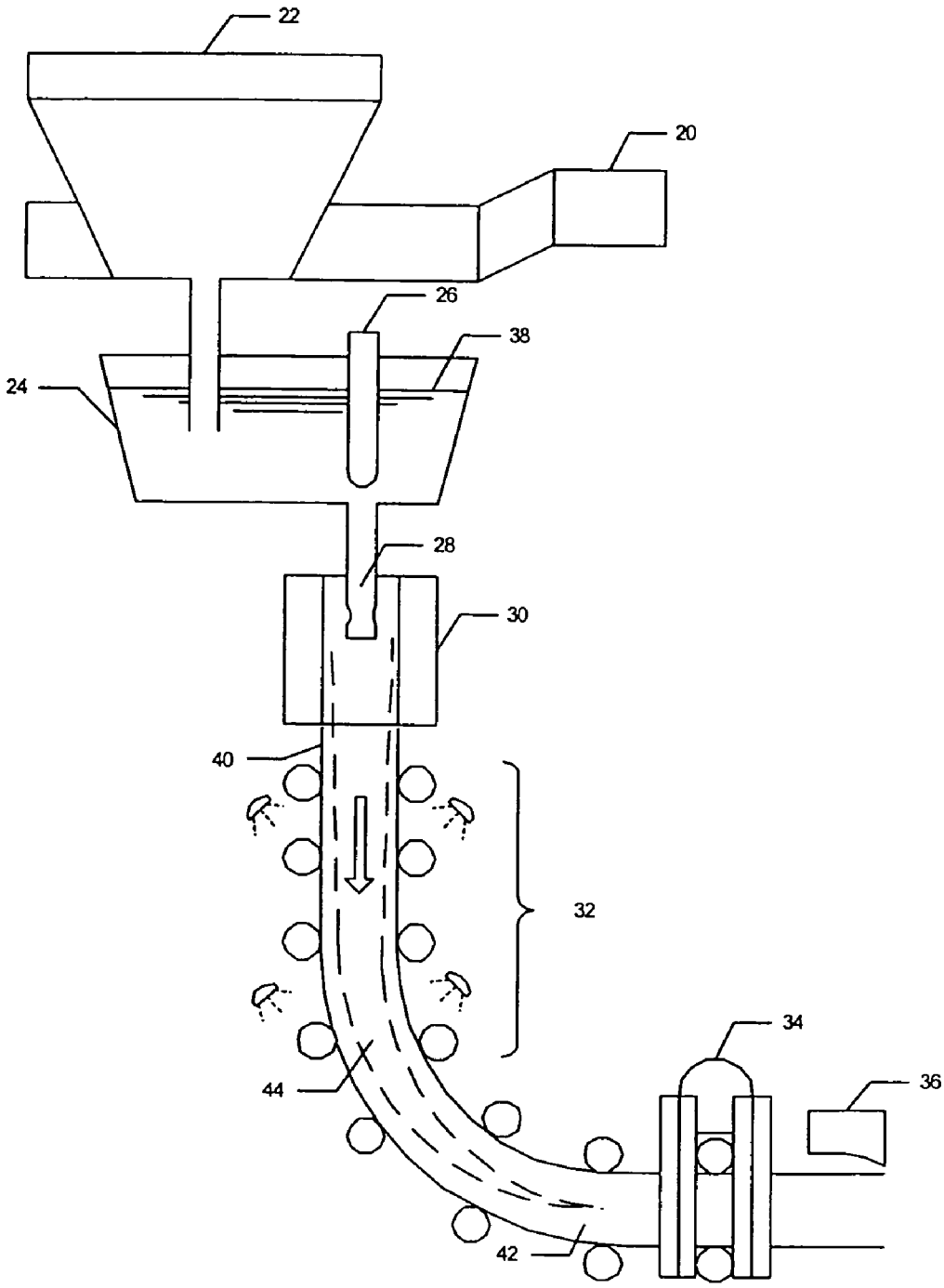
FIG. 1 is a schematic diagram of a continuous caster according to the prior art.
Figure 2:
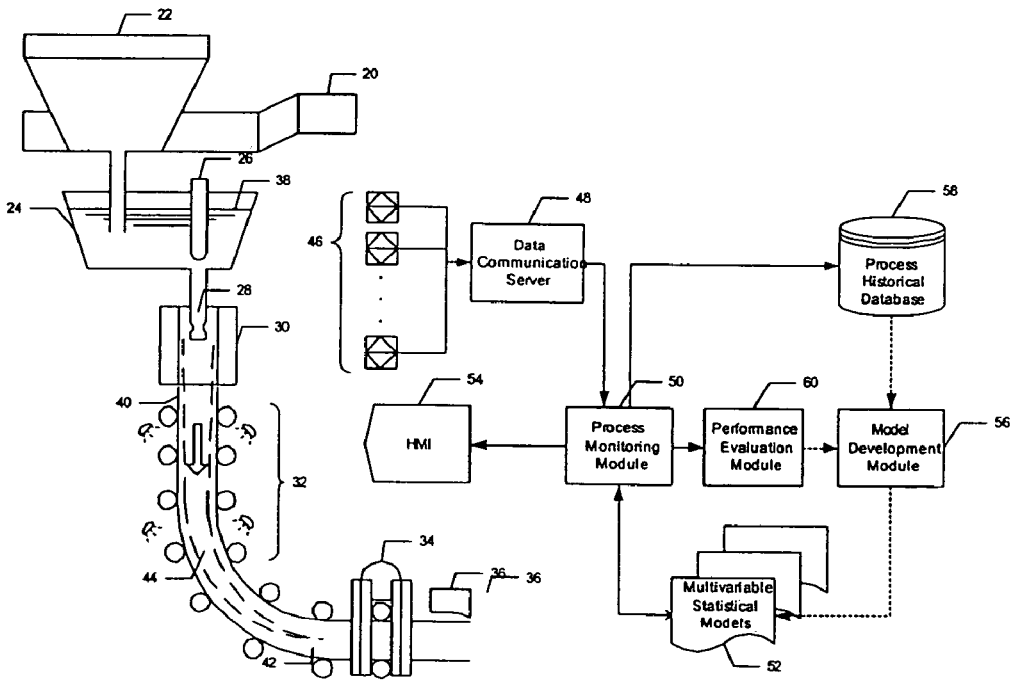
FIG. 2 is a schematic diagram of a start-up operation monitoring system applied to a continuous caster.

As described previously, one example of these continuous casters is shown in FIG. 1. For such a continuous caster, an online computer system that is able to monitor the caster start-up operation and predict start cast breakouts is depicted in FIG. 2. In addition to the process part, there are many different types of sensors 46 located throughout the entire continuous caster and each sensor obtains a different measurement that represents the current operating condition of the continuous caster. These measurements may include, but are not limited to, tundish weight, mold temperatures, molten steel level in the mold, temperatures and flow rates of inlet and outlet cooling water, and so on. Note that the sensors and obtained process measurements may be different in various process designs of continuous casters, and the invention is not limited thereto. The measurements obtained from these sensors are collected online, in real-time, by a data communication server 48, and then sent to an online process monitoring module 50. Once the process monitoring module receives the-real-time process measurements, a series of calculations are performed based on a given multivariable statistical model 52 to predict an impending start cast breakout. The resulting alarms and the identified most likely root causes of the predicted breakout are sent and displayed in a human-machine interface (HMI) 54. At the same time, the process monitoring module is responsible for sending the real-time process data to a historical database 58 for data archiving purposes. The multivariable statistical models 52 are built offline by a model development module 56 in which the normal start-up operation of continuous caster is characterized by the model from the selected historical data in the database 58. When the model is implemented online, some model parameters are updated online based on the latest available start-up operation data in order to partially compensate for possible drifts from a normal start-up operation region not characterized by the models. In addition, a performance evaluation module 60 is added into the system to monitor alarms of start cast breakouts and determine if the model needs to be re-built based on recent start-up operation data.

Figure 3:
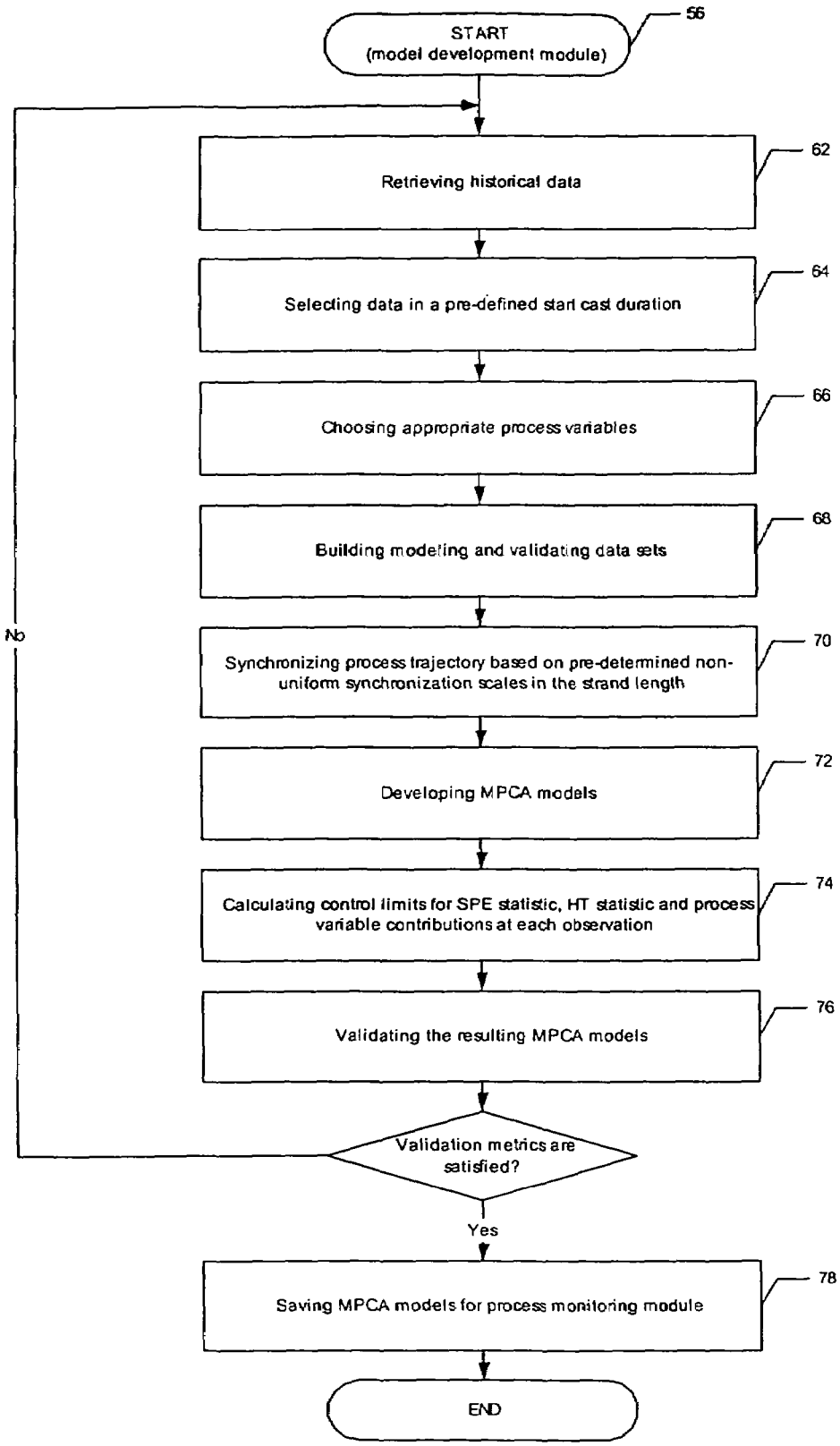
FIG. 3 is a flow chart setting forth the steps in the model development module 56 of this invention to build a MPCA model from selected historical data in order to characterize normal operation of a caster start-up operation.

FIG. 3 is a flow chart setting forth the steps in the model development module 56 of this invention to build a MPCA model from the selected historical data in order to characterize the normal operation of caster start-up operation. In a preferred embodiment described below, each step is explained in detail where there are a number of aspects to the invention that impact on its successful realization.

Retrieve Historical Data

In order to build a MPCA model to characterize the normal start-up operation of a continuous caster, a large number of historical data covering most of a normal operation region in a caster start-up process are required.

The historical data retrieval procedure at 62 will now be described in detail with reference to a preferred embodiment. A total of 124 process variables, including actual sensor measurements and calculated engineering variables related to the continuous caster, are collected from a process historical database 58, at the sampling interval of 400 ms over about a 12-month period. Note that the time period and the sampling interval specified herein are illustrative of a preferred settings for collecting a sufficient amount of data at a satisfied sampling frequency in comparison with the operation speed of continuous caster, and this invention is therefore not limited thereto.

The historical data retrieval procedure results in a two-dimensional data set with 124 process variables by 216,000 observations during a 24-hour period of operation, and a fairly large data matrix over the 12-month period.

After the historical data have been retrieved, the resulting data set needs to be reduced to render itself suitable for the model development purposes. In one preferred embodiment, the data reduction is achieved by selecting data in a properly defined duration and choosing the appropriate process variables that are able to represent the nature of caster start-up operations.

Select Data in a Pre-Defined Start Cast Duration

Figure 4:
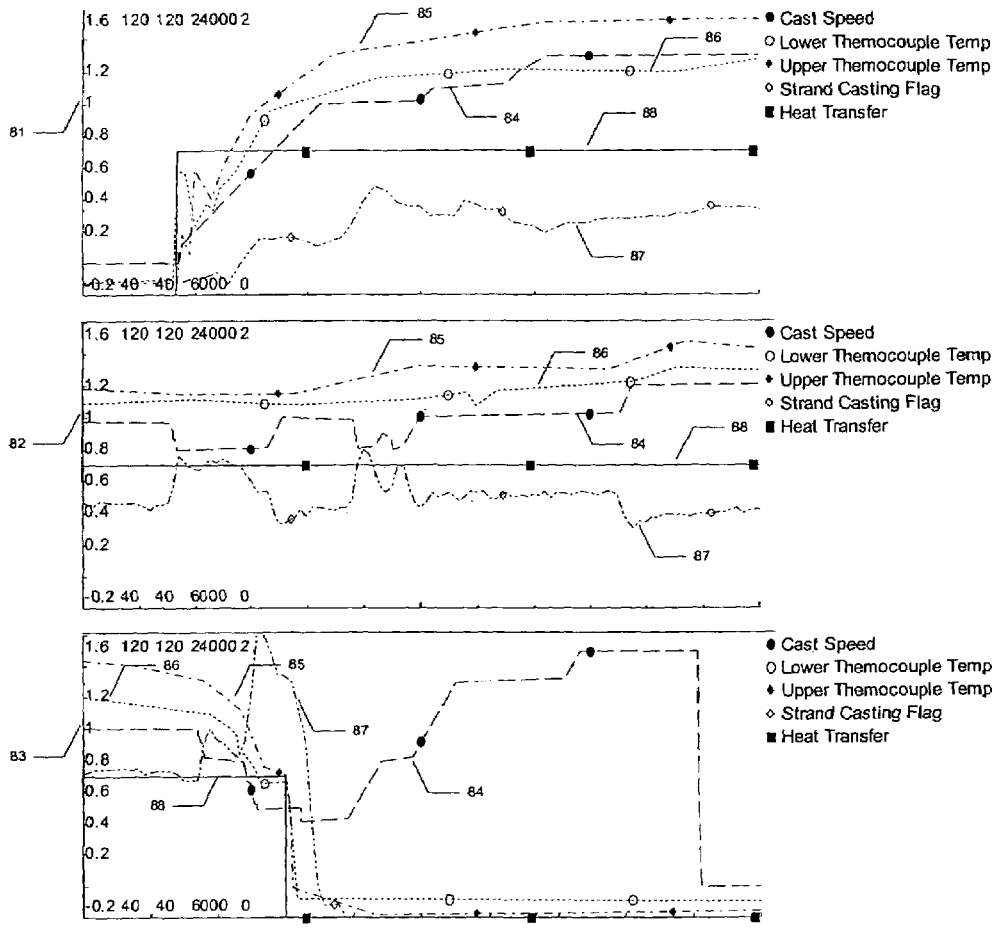
FIG. 4 is a graph to illustrate a normal operation sequence of a continuous casting process.

The entire operation sequence of a continuous caster consists of the following three phases: a start-up operation 81, a run-time operation 82 and a shut-down operation 83. FIG. 4 gives some examples of the obtained historical data showing the process trajectories of certain process variables in different phases. The process variables shown in FIG. 4 include the casting speed 84, two thermocouple temperatures 85 and 86, one heat flux 87 transferred through a selected mold face, and the strand casting flag 88 that indicates whether the continuous caster is actually producing strands.

The start-up operation refers to the very beginning period of the entire operation sequence. During this finite period, the casting speed, in a preferred embodiment, is continuously increasing from 0.1 m/min to 0.7 m/min or higher. At the same time, most of the process variables such as thermocouple temperatures and heat flux illustrated in 81 reveal different dynamic transitions with increasing speed 84. Run-time operation often follows a start-up operation when the continuous caster runs smoothly in a normal casting speed range. During the run-time operation, the casting speed may drop down below 0.7 m/min within a very short period for some special operating tasks, for example, tundish exchange, SEN change, etc. A normal operation sequence of a continuous caster ends with a shut-down operation in which the casting speed drops dramatically down to zero.

In order to monitor the start-up operation and predict start cast breakouts using MPCA technology, the duration of the start-up operation, also known as start cast duration, must be distinctly defined. In one preferred embodiment, the casting time is not used to define the start cast duration as usual because the start-up operation may end sooner or later due to the varied acceleration of casting speed (i.e., the casting speed may increase, remain constant, or even decrease at any time in the start cast duration). Instead, a calculated process variable, strand length, along with the casting speed, is used to define the start cast duration as follows:

start cast duration begins with the time, denoted by to, when the casting speed exceeds 0.1 m/min. At this time, the strand length, denoted by L, is set to equal zero, i.e., $L(t_0)=0$;

as the start-up operation evolves, the strand length at time t is calculated by:

$$L(t)=L(t-1)+v(t-1)*t_s$$

where t and t−1 represent the current and previous time interval, respectively; v(t−1) is the casting speed measured at time t−1 and $t_s$ is the preferred sampling interval;

the start cast duration then ends by the time, denoted by $t_f$, when the strand length exceeds 3.2 meters, i.e., $$t_f=\min\{t|L(t)\geqq 3.2,\ t>t_0\}$$

The value of 3.2 meters is initially selected based on prior process knowledge and then verified by the steady-state detection to make sure the caster operation reaches a steady state at the end of the start cast duration. One skilled in the art will realize that this value may vary depending on the different casting processes and still produce acceptable results and, therefore, this invention is not limited thereto.

Once the start cast duration is defined, only the data in this duration of each operation sequence are selected at 64.

Choose Appropriate Process Variables

Choosing appropriate process variables is the other crucial issue to the success of data reduction. The procedures to choose appropriate process variables follow a number of simple methods such as utilizing process knowledge, visual inspection or statistical calculation, etc., which is described below in detail. These methods may be utilized individually, or preferably in combination, to choose the process variables having significant impact on start cast breakouts.

As previously indicated, a total of 124 process variables are retrieved from the historical database, and they can be categorized into the following groups:

thermocouple readings, including a total of 44 mold temperatures and their differences;

mold information, including mold oscillation frequency, stopper-rod position, SEN immersion depth, mold width, etc.;

tundish information, including tundish car net weight, SEN argon flow, etc.;

cooling water information, including inlet/outlet cooling water flows and temperatures;

heat transfer information, include heat flux transferred through mold faces;

composition information, including the composition of carbon, manganese, silicon, etc. in the molten steel.

In a preferred embodiment, a series of criteria are applied for choosing appropriate process variables:

by utilizing process knowledge, all variables that are known to be crucial to start-up operations or relevant to start cast breakouts are selected;

by performing visual inspection, all variables that reveal a dynamic transition in the start cast duration defined at 64 are selected; whereas, any variable that shows very infrequent changes in comparison with the process dynamics in the start cast duration is not selected;

by performing statistical calculations, any variable that contains more than 20% missing data in the start cast duration, or that has very small variance in the deviation from its average trajectory (calculated from available historical data), is not selected.

Applying these criteria results in 62 of the 124 process variables are selected in the step 66 of FIG. 3. They are:

mold thermocouple readings;

temperature differences between the pre-defined thermocouple pairs (see below);

stopper rod position;

tundish car net weight;

mold cooling water flows;

temperature difference between inlet/outlet mold cooling water;

casting speed;

calculated heat flux transferred through each mold face.

Figure 5:
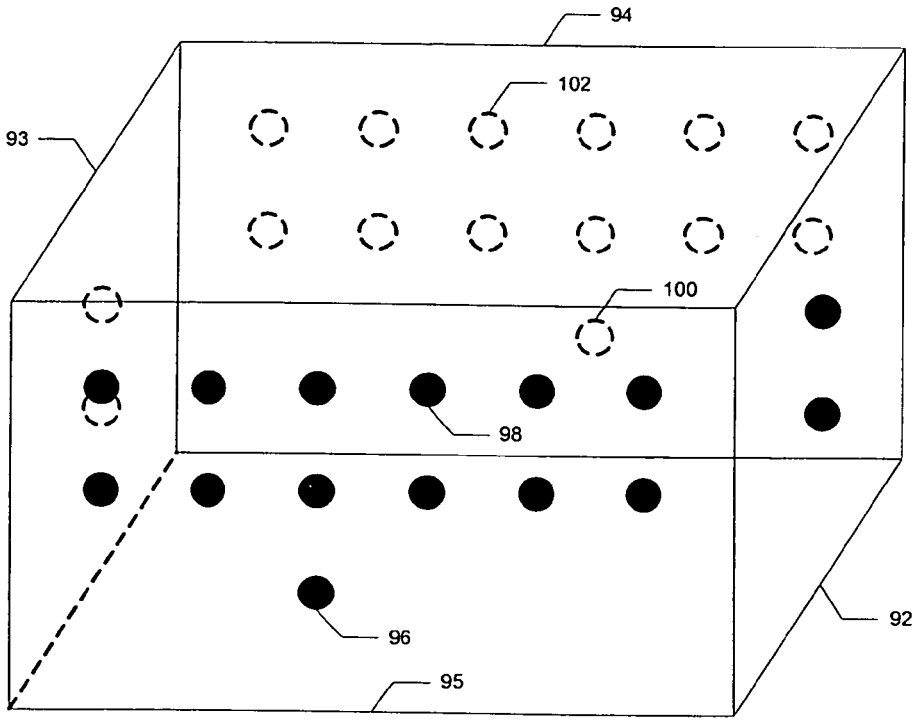
FIG. 5 is a schematic of a continuous caster mold used in this invention, providing the location of each thermocouple around the mold and defining thermocouple pairs.

In a preferred embodiment, the thermocouple locations around the mold are shown in FIG. 5. In the east side 92 and west side 93 of the mold, there are two thermocouples forming a vertical pair, respectively. In the north side 94 and south side 95 of the model, there are thirteen thermocouples respectively, where twelve of them form six vertical pairs. Two extra pairs are formed by 96 and 98 in the south side and 100 and 102 in the north side. The heat flux transferred through each mold face is calculated as follows:

$$Q=C_p*F_w*\Delta T/A$$

where Q is the calculated heat flux, $C_p$ is the heat capacity of cooling water, $F_w$ is the cooling water flow, ΔT is the temperature difference between inlet and outlet cooling water and A is the area of the mold face.

One skilled in the art will realize that if any other process variables become available which satisfy the above criteria, they will be selected in order to improve the model quality and further improve the performance of the start cast breakout prediction. As a result, the invention is not limited thereto.

Build Modeling and Validating Data Sets

Figure 6:
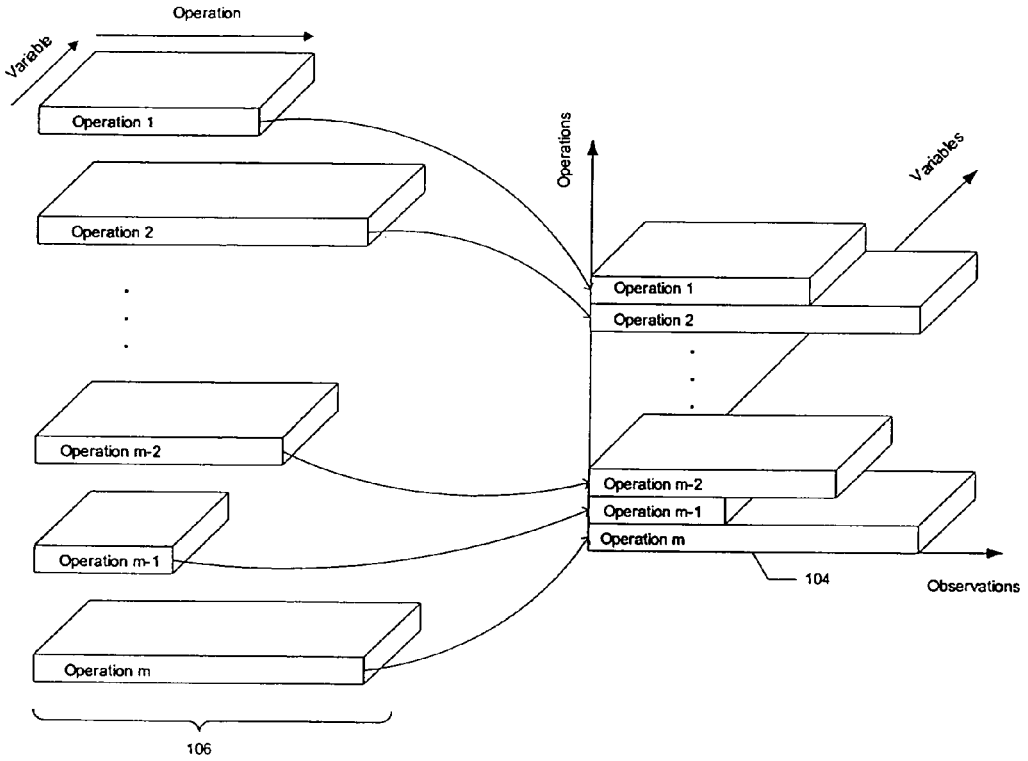
FIG. 6 is a graph to illustrate the caster start-up operation data in three dimensions.

After reducing the large data set retrieved from the historical database by selecting the data of appropriate process variables in the defined start cast duration, the reduced data set are re-organized as a three-dimensional data block 104, as demonstrated in FIG. 6, where each start-up operation 106 is described as a two-dimensional data matrix with selected variables by a number of observations in the start cast duration. More specifically, the element (i,j,k) of the data block 104 refers to the value of variable j at observation i in No. k operation. Note that, in this data block, each start-up operation has the identical sampling interval of 400 ms, however, they may have a different number of observations since the start cast duration will vary from one operation to another.

The start-up operations can be categorized into 3 groups by applying the following criteria:

a start-up operation belongs to group A if a start cast breakout occurs in this operation;

a start-up operation belongs to group B if no breakout occurs in this operation and the following conditions are satisfied: there is no missing data in the casting speed; the casting speed at the beginning of the start cast operation is less than 0.1 m/min; the width of casting strand is not changed in the entire start cast duration; the average casting acceleration over the entire start cast operations is greater than 0.0015 $m^2/s$; and the temperature difference between upper and lower thermocouples in one thermocouple pair is less than 5° C. at the beginning of the start cast duration and greater than 10° C. in the end;

the rest of start-up operations belong to group C.

As a result, two data sets, a modeling set and a validating set, are built at 68 from group A and B. For example, in one preferred embodiment, 80% start-up operations in group B are arbitrarily selected to build the modeling set; and the rest 20% start-up operations in group B as well as all start-up operations in group A are selected to build the validating set. The modeling set is used to develop MPCA models to predict the start cast breakout; and the validating set is used to validate the prediction performance of the developed models when presented with a new start-up operation.

The modeling set should span the normal operating region, and it is required that the modeling set contains at least 100 start cast operations.

Note that the above settings for building modeling and validating sets may change in different embodiments and the invention is not limited thereto.

Synchronize Process Trajectories

The invention is adapted to build a statistical model for the deviation of each pre-selected process variable from its average trajectory using the historical data in normal start-up operations. Then it compares the deviation from the average trajectory of the same process variables in a new start-up operation with the model; any difference that cannot be statistically attributed to the common process variation indicates that the new operation is different from the normal operation. Such comparison in this invention requires all trajectories in different start-up operations to have equal duration and to be synchronized with the progress of start-up operations.

As previously indicated, in either a modeling set or a validating set, each start-up operation has different numbers of observations. Such data are not suitable for building a MPCA model.

In a preferred embodiment of the invention, a process trajectory synchronization procedure at 70 is developed based on non-uniform synchronization scales in the strand length and will be described in detail below.

Figure 7:
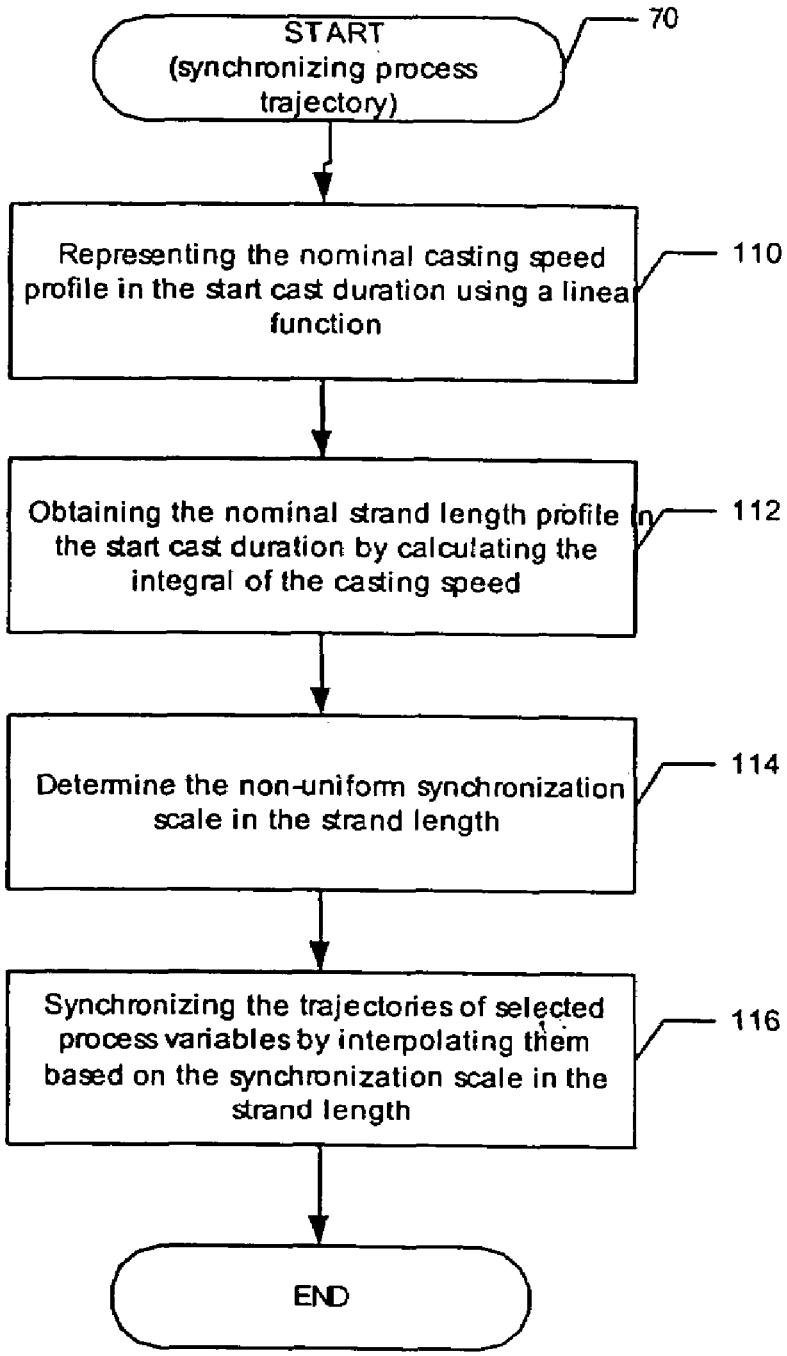
FIG. 7 is a flow chart setting forth the steps of synchronizing process variable trajectories with respect to the strand length in the start cast duration.

Referring to FIG. 7, four steps are followed to synchronize the process trajectories.

First of all, a nominal casting speed profile is obtained at 110 from its historical data. A linear function is used to approximately describe the increasing casting speed profile, denoted by $v_0$, with respect to time t:

$$v_0(t)=a*t+b$$

where, in a preferred embodiment, the parameter a is equal to $4.15\times10^{-5}$ and b is equal to $1.7\times10^{-3}$.

Then the nominal strand length, denoted by $L_0$ can be obtained at 112 by calculating the integral of the nominal casting speed:

$$L_0(t)=0.5*a*t^2+b*t$$

Next, the nominal strand length is re-sampled at 114 by the non-uniform synchronization scales, which is denoted by s and determined by:

$$s(i)=0.5*a*(i*T/N)^2+b*(i*T/N), i=0 \ldots N$$

where i is the index of s; T is the nominal duration of start-up operation that is calculated by $L_0(T)=3.2$ meters; and N is the number of scales in the strand length. A guideline for determining the value of N is given by:

$$N=\min\{n|T/n<t_s,\ n>0\}$$

where $t_s$ is the sampling interval that is equal to 400 ms in a preferred embodiment of this invention.

Once the synchronization scales in the strand length have been determined, the trajectory synchronization is performed at 116 by interpolating the trajectories of other selected process variables based on the scales in the strand length. Thus, in the synchronized data set, each observation corresponds to a synchronization scale in the strand length.

Note that, instead of non-uniform synchronization scales in the strand length, uniform scales can also be applied to the strand length for the trajectory synchronization purposes. That implies the strand length is re-sampled evenly by N samples. However, this method causes the MPCA calculation to be performed less frequently at the beginning of the start cast operation than at the end of that, since the casting speed is almost always increasing during the course of a start cast operation. As we know, the caster start-up operation normally follows three-stages: the initial start, the dynamic transition and the final steady-state, and most commonly, it shows more process disturbances in the initial start stage and the beginning of the transition stage. Therefore, a uniform scale method may result in losing opportunities to detect start cast breakouts at an early stage. In contrast, the non-uniform scale method will provide an opportunity to detect early start cast breakouts, especially when they occur in the initial start and transition stages.

Figure 8:
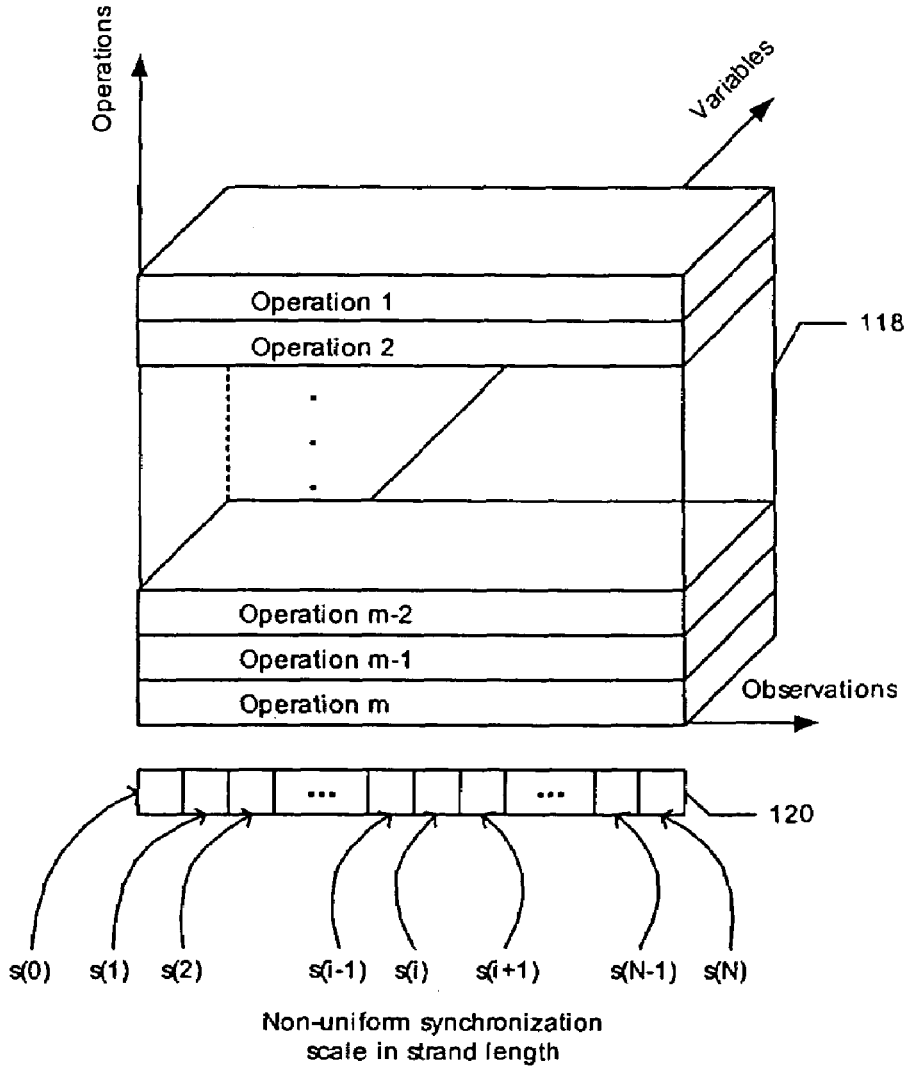
FIG. 8 is a graph to illustrate the synchronized caster start-up operation data aligned with respect to the non-uniform synchronization scales in the strand length.
Figure 9:
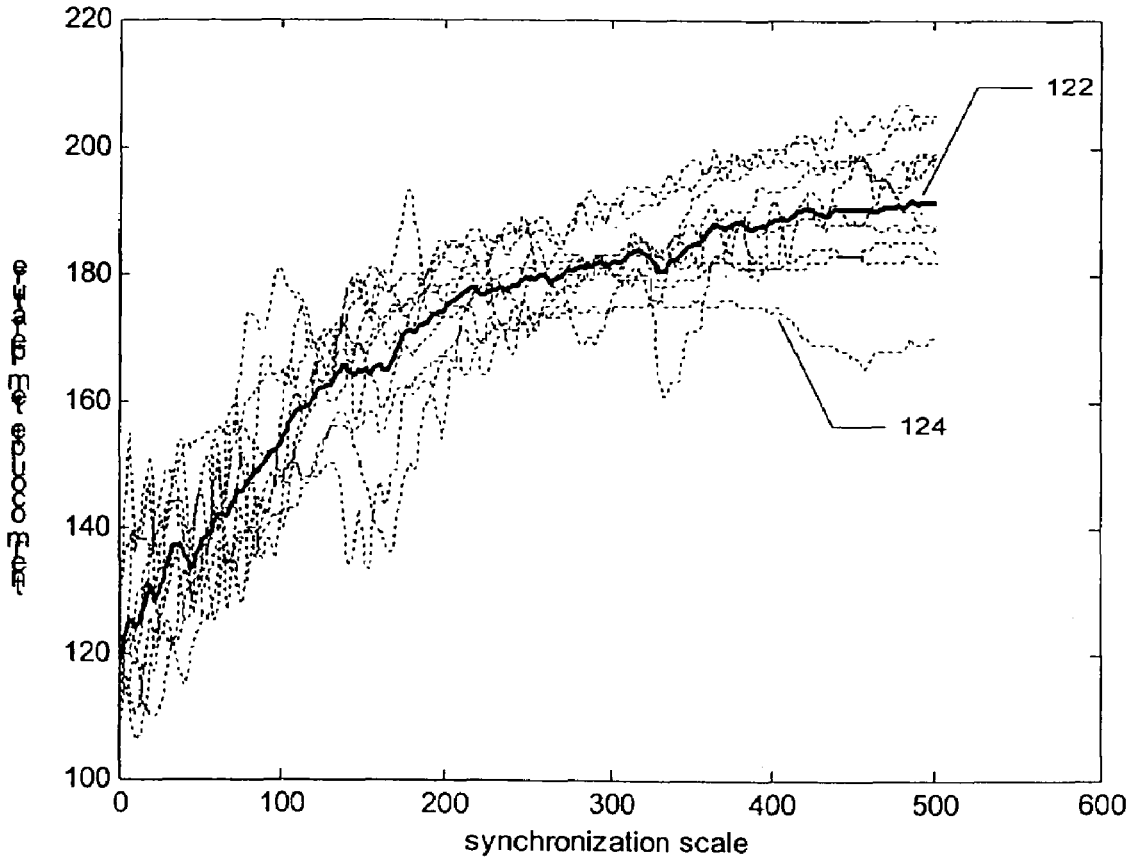
FIG. 9 is a graph to illustrate the average trajectory calculation based on the synchronized trajectories in the modeling set.

As a result of performing trajectory synchronization, a new three-dimensional data block 118 is obtained as shown in FIG. 8, where all process trajectories in different start-up operations are aligned with respect to the given synchronization scales 120 in the strand length. Furthermore, in the data block 118, the average trajectory of each selected process variable can be easily calculated. FIG. 9 shows one example of the resulting average trajectory 122 of a given number of synchronized trajectories 124.

Develop MPCA Models

Prior to system online implementation, MPCA models are determined at 72 (FIG. 3) based on the synchronized data in the modeling set. The data in the synchronized three-dimensional data block 118, as previously described in FIG. 8, are mean-centred and auto-scaled to zero mean and unit variance in the column-wise. Mean-centering is used to subtract the average trajectory of each process variable such that the data will only represent the deviation from the average trajectory and, hence, the process nonlinearity is, at least partially, removed. Auto-scaling is used to obtain a zero-mean, unit variance distribution for each variable at each observation in order to assign the same priority weight to the variable.

Figure 10:
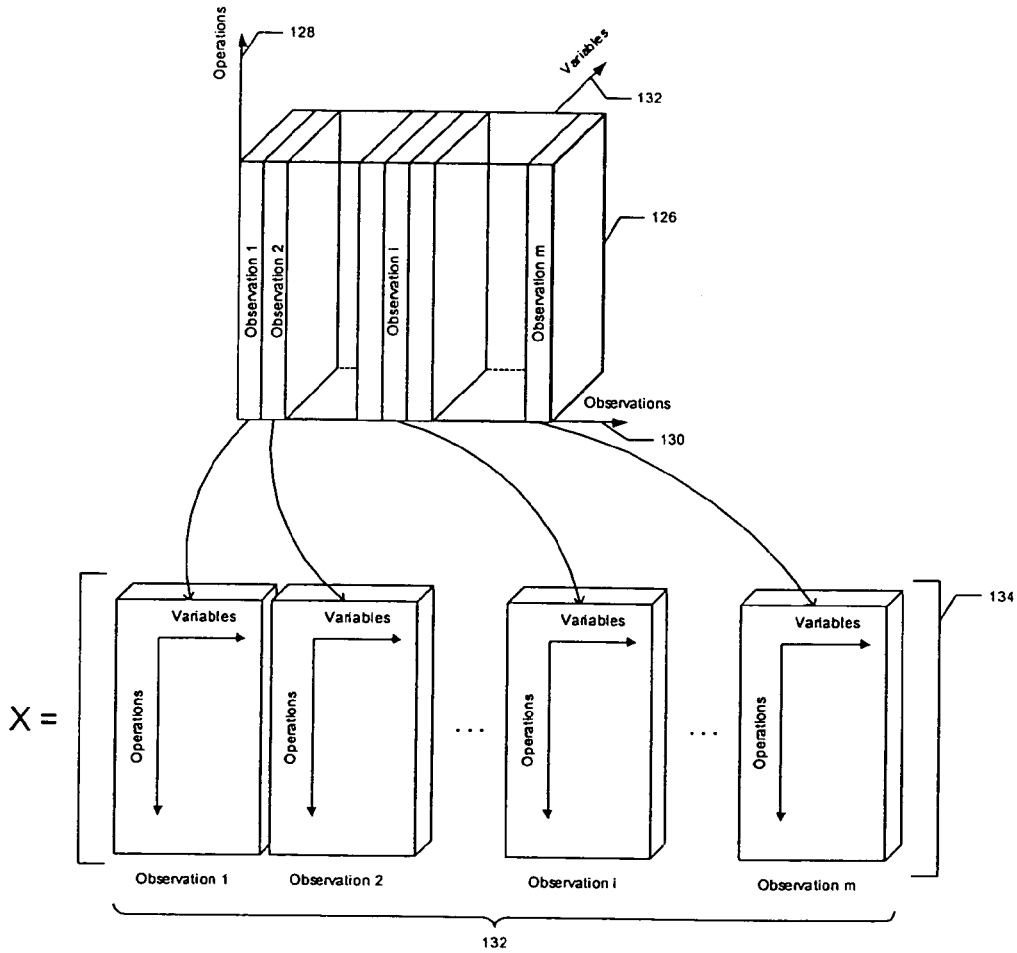
FIG. 10 is a graph to illustrate the three-dimensional caster start-up operation data block being unfolded to a two-dimensional data matrix to preserve the direction of start-up operations.

Referring to FIG. 10, the core concept of the MPCA technology is to unfold the resulting mean-centred and auto-scaled three-dimensional data block 126 to preserve the direction of start-up operations 128. The data block 126 is sliced vertically along the observation direction 130; the obtained slices 132 are juxtaposed in order to build a two-dimensional data matrix X 134 with a large column dimension such that each row corresponds to a start-up operation. A standard PCA algorithm is then applied to this unfolded data matrix X: the data in this matrix are projected to a new latent variable space defined by a loading matrix P, where most of the process variance contained in the original data is captured by only a few latent variables, also known as principal components. The values of principal components for each start-up operation are called scores, denoted by T. Two statistics, Squared Prediction Error (SPE) and "Hotelling T" (HT), are defined at each observation based on the loading matrix P and the scores T, such that they are able to describe how each operation in the modeling set is coincided with the normal operation as the operation evolves with increasing strand length.

Similar to the philosophy of univariate statistical process control, the control limits for both SPE and HT are required to be determined at 74 (FIG. 3) in order to monitor a new start-up operation. Theoretically, these two statistics follow known probability distributions under the assumption that all process variables and the resulting scores T are multi-normally distributed. Such an assumption, however, cannot be applied to the caster start-up operation. In a preferred embodiment of this invention, the control limits for both SPE and HT are determined by the historical data in the modeling set as follows. For each operation in the modeling set, SPE and HT at each observation in the strand length are calculated. At each observation, the histograms of SPE or HT over all start-up operations in the modeling set are plotted and the SPE or HT control limit at this observation are determined such that only 5% of operations in the modeling set have the SPE or HT beyond the control limit.

Furthermore, the contribution of each variable to SPE or HT, at each observation in the strand length, is also calculated. The same method described above is applied to determine the control limits for these contributions.

A number of models may need to be developed to cover the entire range of caster operating conditions. This depends greatly on the process itself and if there are a number of distinct conditions of operation, each of which may require a separate model. Typical factors that may influence the number of models required include, but are not limited to, the steel grade, the width of casting strand and so on. In one preferred embodiment of this invention, three MPCA models are developed:

- wide-casting model that is applied to the start-up operations where the width of the casting strand is greater than 1.25 meters.
- intermediate-casting model that is applied to the start-up operations where the width of the casting strand is greater than 1.0 meter and less than or equal to 1.25 meters.
- narrow-casting model that is applied to the start-up operations where the width of casting strand is less than or equal to 1.0 meter.

One skilled in the art will realize that a specific model could be built for a distinct operating condition in order to improve the performance of start cast breakout predictions, and therefore the invention is not limited to the three models described above.

Validate the Resulting Model

The last step in the method before putting the resulting MPCA models into an online monitoring system is to validate the model using the start-up operation data in the validating set defined at 76 (FIG. 3).

As described previously, the validating set includes both normal start-up operations and abnormal operations with the start cast breakouts. Three benchmarks are used in one preferred embodiment to validate the resulting model:

- the false alarm rate, also known as the Type I Error in statistics;
- the failed alarm rate, also known as the Type II Error in statistics;
- the lead-time to breakout, which refers to the time interval between the first alarm to a actual breakout.

The initial values are set to 20% for the false alarm rate, 10% for the failed alarm rate, and 3 seconds for the lead-time to breakout. Once the model successfully passes these validation benchmarks, it is ready for online implementation.

The skilled in the art may realize that the aforementioned benchmarks must be balanced in order to obtain a practical MPCA model in terms of model performance and robustness. That is, the model should show good predictability of start cast breakouts and at the same time, be fairly robust to common process disturbances.

Some methods may be utilized to tune the model for satisfying the pre-determined validation benchmarks. These methods include, but are not limited to:

- increasing the size of the modeling set by getting more normal start-up operations;
- refining the selected process variable list to avoid any crucial process variable being missed;
- increasing the number of principal components to capture more process variance, or decreasing it to result in a more robust model;
- retuning the control limits for SPE and HT statistics;
- classifying caster start-up operations by conditions (such as grades of products, etc.) and developing models for each distinct operating condition.

These methods can be applied individually, or preferably in combination to develop a practical model satisfying the actual requirements of the caster start-up operation monitoring.

After successful completion of the above procedures in the model development module at 56, a set of MPCA models 52 is developed and is ready for online implementation. These models contain all necessary information for executing all calculations in the process monitoring module 50 to monitor a new caster start-up operation online, in real-time, and predict an impending start cast breakout (FIG. 2).

Once the MPCA models 52 are developed offline at 56, they are loaded into the online process monitoring module 50. The process monitoring module contains intensive steps on how to utilize the MPCA models to achieve the desired results, which are described as follows.

Figure 11:
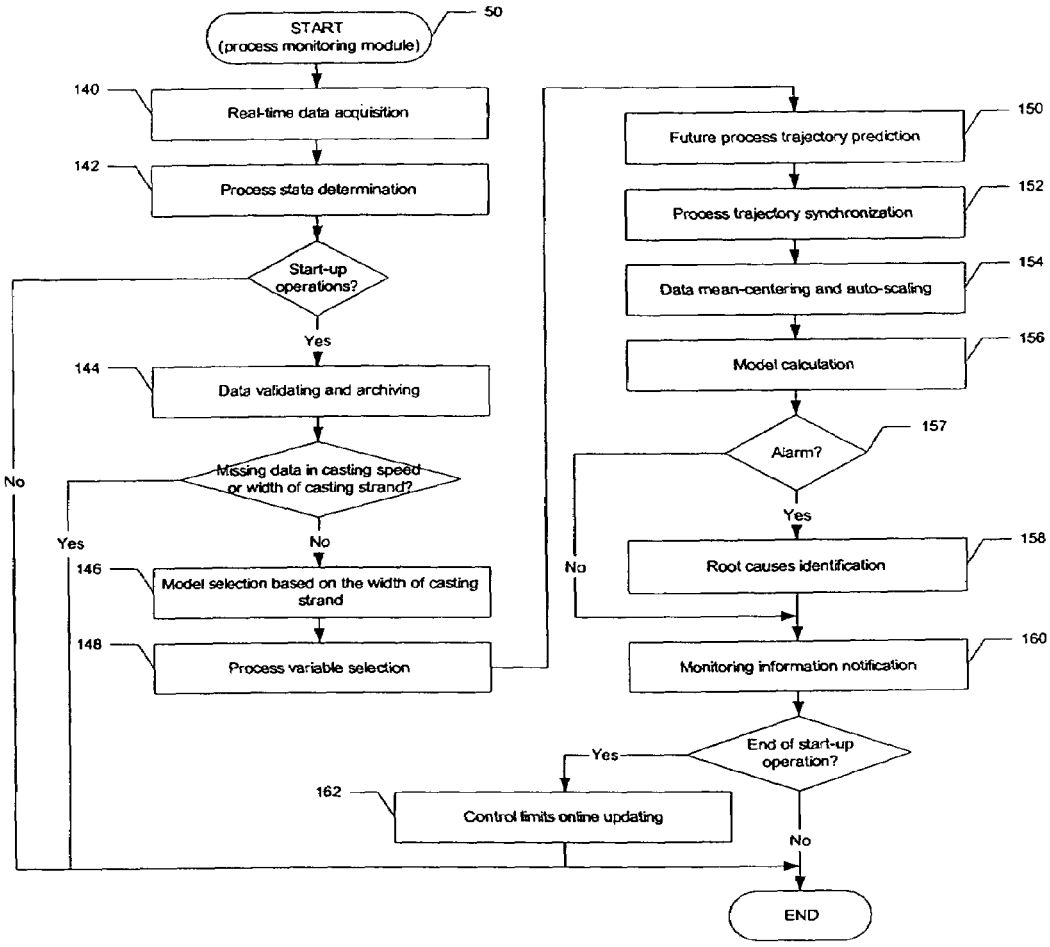
FIG. 11 is a flow chart setting forth the steps of a process monitoring module used in this invention to monitor a new caster start-up operation, predict an impending start cast breakout and identify the process variables as most likely root causes of the predicted breakout.

Referring to FIG. 11, in one preferred embodiment, all sensor measurements of a new caster operation are collected online at 140 at a pre-determined sampling interval. The real-time measurements are continuously sampled and input to the process monitoring module, where a temporary data buffer is designed to store these data as required. Based on the real-time measurements, the current process state—either start-up operation or run-time operation—is determined at 142. If, and only if, the process is in the state of start-up operation, the following calculations can be performed.

If this is the case, the acquired measurements are first validated with their respective acceptable ranges, and any invalid readings are flagged as "missing" at 144. If missing data are detected in either the casting speed or the width of casting strand, then the calculation will stop because they are considered critical variables to successful monitoring a start-up operation; otherwise, one of MPCA models 52 developed at 72 is selected depending on the actual width of the casting strand.

Once the selected model is loaded into the process monitoring module, the process variables required by the model are chosen at 148. Their process trajectories, from the beginning of the start-up operation to the current time, are known from the above data buffer; and the rest of the trajectories in the future observations are predicted at 150 on the assumption that the current deviation from the average trajectory remains constant over the rest of the start cast duration. The complete, predicted trajectories of selected process variables are synchronized at 152 based on the non-uniform synchronization scales determined at 70, and aligned with respect to the strand length to form a two-dimensional data matrix $X_{new}$, where the element $X_{new}$ (i,j) represents the synchronized value of variable i at the observation j.

The $X_{new}$ is pre-processed at 154 to center each variable at each observation around zero and scale to unit variance. Next, the process monitoring module unfolds the preprocessed data matrix following the same method described at 72, and then, at 156, computes the statistics, SPE and HT, using the loading matrix P in the selected MPCA model. These statistics provide information on how the present start-up operation is statistically different from the model, or more specifically, the normal start-up operation characterized by the model and, hence, infers the condition of the caster.

At 157, if either SPE or HT statistic of a new start-up operation exceeds its control limit over 3 consecutive sampling intervals, then an alarm is generated to indicate an impending start cast breakout or an abnormal situation. An HT alarm implies the present start-up operation is deviating from the normal operation region and a potential start cast breakout may occur. Whereas, an SPE alarm indicates the inherent correlation within the selected process variables has been broken and a start cast breakout is highly likely. These two types of alarms may be generated individually, or in most cases, they are generated together. In the event of SPE and/or HT alarms, a certain number of process variables are identified as the most likely root causes to the predicted breakout based on their contributions to the SPE and/or HT statistic, at 158. Both alarms and identified root causes are sent, at 160, to an HMI 54 to notify operators such that they are able to take advantage of the provided information to perform further diagnosis or make a corrective decision to avoid the actual occurrence of the predicted breakout.

At the end of each start-up operation, the control limits of SPE, HT and the contributions are updated online at 162.

Figure 12:
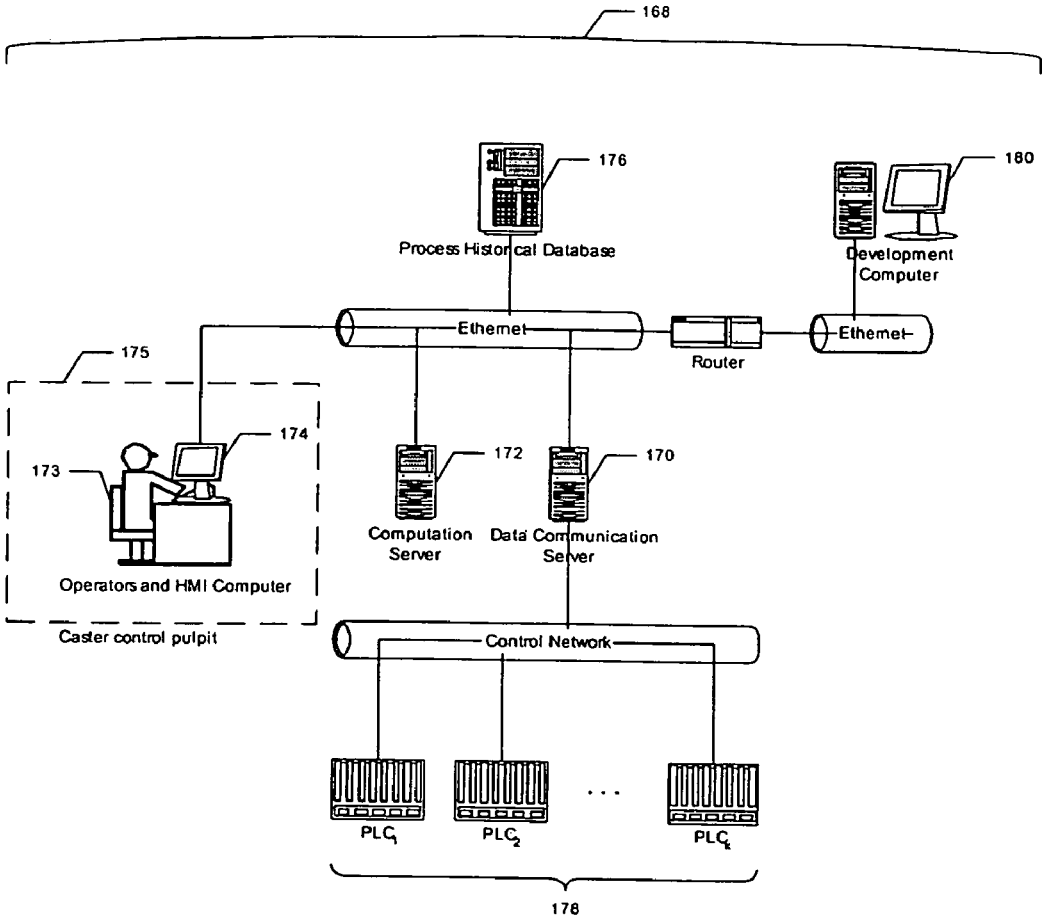
FIG. 12 is a schematic of a computer network system for implementing the caster start-up monitor system to predict start cast breakouts.

A computer system 168 is designed for the online implementation of the caster start-up operation monitoring system. Referring to FIG. 12, four networked computers are configured as follows:

- a data communication server 170 is connected to all programmable logic controllers (PLC) 178, which supply real-time process data to other computers;
- a computation server 172 is able to receive the real-time data via the data communication interface, perform the MPCA calculation, and send the alarm-related information to HMI machine and at the same time, send the real-time data to a process historical database 176 for data archiving purposes;
- a HMI computer 174, located in the caster control pulpit 175, is able to display the current start-up operation conditions based on the provided SPE and HT statistics and the identified most likely root causes to a predicted breakout, alarm an impending start cast breakout or an abnormal situation, and support operators 173 to make a correct decision when an alarm is generated;
- a process historical database 176 is configured to store process historical data that will be used when the MPCA models are required to be re-built.

Additionally, a development computer 180 is required to offline develop the MPCA models, which is also shown in FIG. 12.

One skilled in the art will realize that the aforementioned computer system may vary in different circumstances, for example, a customized data acquisition system may be used to replace the data communication server, or the display function in HMI machine may be integrated into the computation server, etc. Therefore, this invention is not limited thereto.

As indicated, there are a number of features in the online system that are novel and non-obvious in the realization of such a system. These features are described in more detail in the text below.

Determine Process State

As previously described, in a continuous caster, a long-term run-time operation often follows a start-up operation. One of features developed for the online system is the ability to monitor both start-up operation and run-time operation in an integrated computer system. In order to do so, such computer system must be able to determine the current state of the process—either in start-up operation or run-time operation, based on the available real-time data, and automatically select the suitable model and calculation modules for process monitoring. In a preferred embodiment of this invention described below, a rule-based process state determination function is developed at 142 in the process monitoring module for this purpose.

Figure 13:
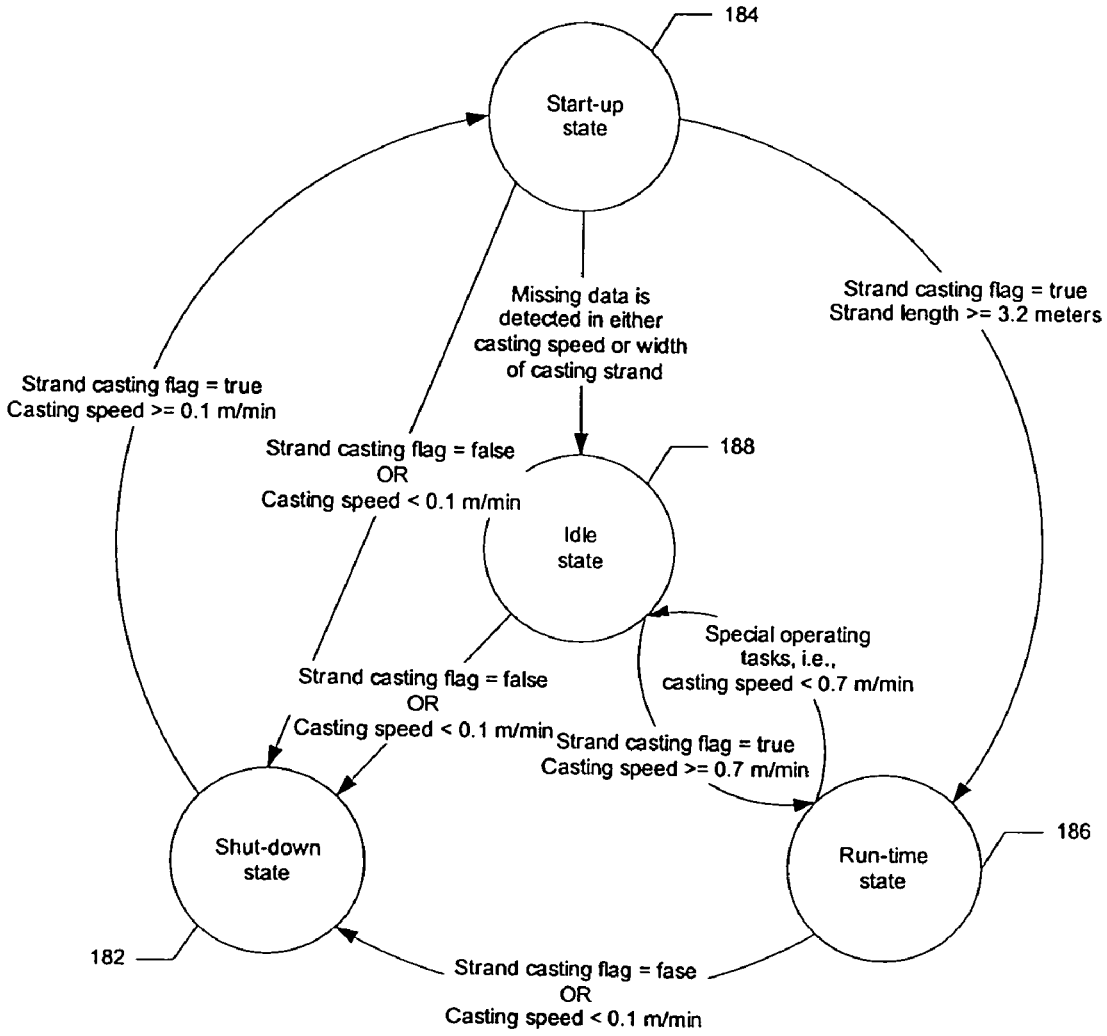
FIG. 13 is a graph to illustrate four system states and state changes among these states to integrate both start-up operation monitoring and run-time operation monitoring in one computer system.

Referring to FIG. 13, three process states are defined as shut-down 182, start-up 184 and run-time states 186. An additional system state, idle state 188, is designed to handle some special operating conditions or unknown situations. At each state, the corresponding calculations are performed, i.e., MPCA calculations are performed at the start-up state, normal PCA calculations (described by Vaculik et al in WO 00/05013) are performed at the run-time state, and no calculation is performed either at the shut-down state or the idle state. Depending on current operating conditions (described by casting speed, strand length and strand casting flag, which indicates whether the continuous caster is actually casting, the system can move from one state to another and, hence, monitor either the start-up operation or the run-time operation.

In a normal casting sequence, the system moves from the shut-down state to the start-up state when the strand casting flag becomes true and the casting speed is greater than or equal to 0.1 m/min. It further moves to the run-time state when the strand casting flag remains true and the strand length exceeds 3.2 meters. And eventually the system moves back to the shut-down state when the strand casting flag becomes false or the casting speed is less than 0.1 m/min.

When the system is in the start-up state, it may move to the idle state if missing data is detected either in the casting speed or the width of casting strand; or move back to the shut-down state if the strand casting flag becomes false. The latter normally happens when a start cast breakout occurs.

When the system is in the run-time state, it may move to the idle state if some special operating conditions are applied, for example, SEN change, flying tundish change, plate insert, etc. If a run-time cast breakout occurs, the system will move back to the shut-down state as described above.

When the system is in the idle state, it may move back to the shut-down state if the strand casting flag becomes false. The system may also move to the run-time state again after the completion of the special operations mentioned above. In addition, if the system changes to the idle state due to missing data detected in start-up operation monitoring, it may move to the run-time state when the strand casting flag remains true and the casting speed becomes greater than 0.7 m/min.

Handle Missing or Invalid Real-Time Data

Missing or invalid real-time data is a crucial issue to the success of online process monitoring of the caster start-up operations. Occasionally, process sensors such as thermocouples, flow meters, etc. may get invalid readings for some reasons. One of the features developed for the online system is the ability to continue monitoring caster start-up operation in the absence of partial real-time sensor measurements. Once the measurements are input to the online system, these data are checked with their respective acceptable ranges and any invalid readings or out-of-range readings are flagged as "missing" at 144. These missing data are then handled by the following rules and methods:

If missing data is found in the casting speed or the width of casting strand, then the missing data is replaced by its previous value. However, if the previous value is also flagged as "missing", then the monitoring system moves to the idle state and no calculation is performed, since these process variables are considered critical to the success of online implementation.

If missing data are found in other selected process variables, they are compensated for as follows:

in the trajectory synchronization at 152, the synchronized data is set to an identifiable number and flagged as "missing" if it is interpolated from any missing data;

in the model calculation at 156, the missing data are replaced by the model-based estimation and then passed through the model calculations; the estimation algorithm is called single component projection, which is described by Nelson et al in Chemometrics and Intelligent Laboratory systems, volume 35, 1996.

Predict and Synchronize Process Trajectories

Figure 14:
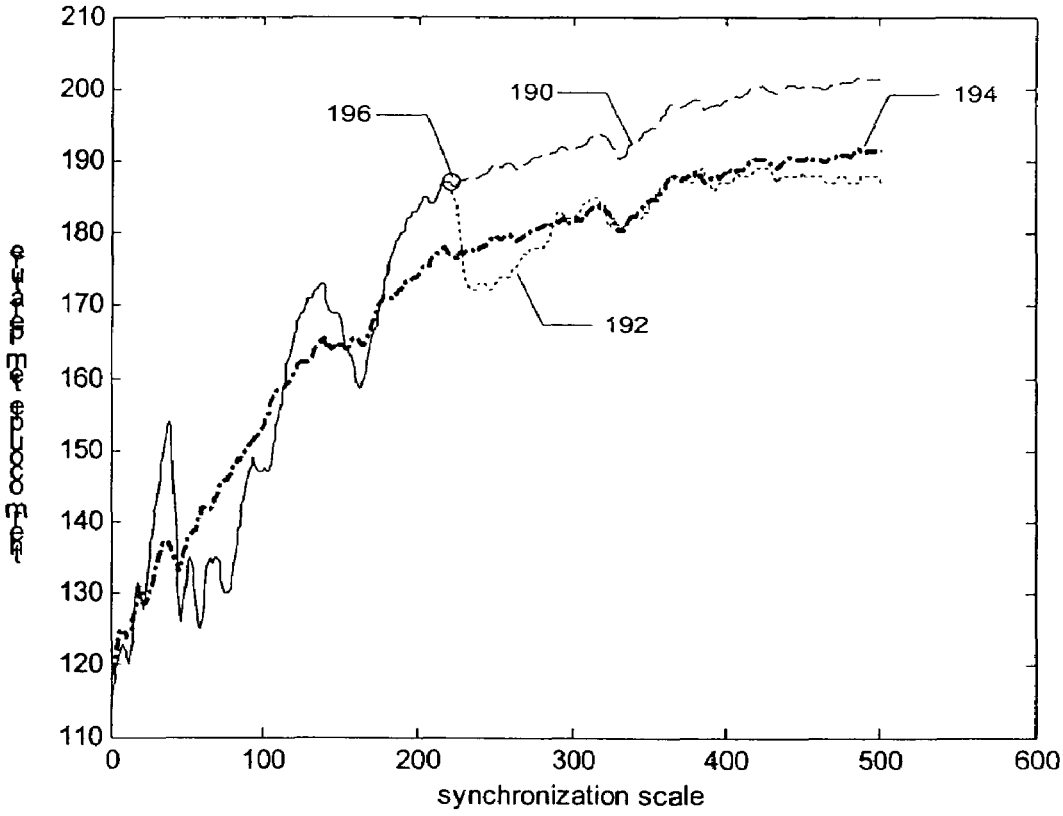
FIG. 14 is a graph to illustrate the future process trajectory is predicted at a certain observation based on the assumption that the current deviation from the average trajectory remains constant over the rest of the start cast duration.

In the caster start-up operation online monitoring system, another crucial issue is to obtain the complete, synchronized process trajectories of a new start-up operation over the pre-defined start cast duration such that these trajectories can be compared to the normal start-up operation characterized by the MPCA models to determine whether a new operation is statistically consistent with normal operation within the entire start cast duration. When a new start-up operation evolves, however, at each observation, the available process trajectories are only up to the current time, and the remaining trajectories from the current time are not available until the end of this start-up operation. One of feature developed for the online system is the ability to predict the trajectories in the future observations. The algorithm used at 150 in one preferred embodiment is described by Nomikos et al in Technometrics, volume 37, 1995. In this algorithm, referring to FIG. 14, the trajectories in the future observations 190, in comparison with its actual trajectory 192, are predicted based on the assumption that the future deviations from the average trajectories 194 as calculated from the historical data in the modeling set will remain constant for the rest of the start cast duration at their current values 196.

One skilled in the art will realize that the above assumption may change to reflect the actual process operation, for example, in some cases, the trajectories in the future observations can be directly predicted by the average trajectories themselves and it may still produce the acceptable results.

The predicted trajectories are then synchronized at 152 (FIG. 1.1) based on the pre-determined non-uniform synchronization scales in the strand length, which is provided by 70 (FIG. 3) in the selected model.

Identify the Process Variables as the Most Likely Root Causes using Current Observation Identifying the process variables as the most likely root causes to a predicted start cast breakout at 158 is an important feature in caster start-up operation online monitoring system, because it can provide valuable information to help operators concentrate only on a few process variables to perform further diagnosis or take appropriate control actions to avoid the actual occurrence of the predicted start cast breakout.

In the prior art of multivariable statistical process monitoring, the cause for a generated alarm are usually identified by a contribution plot, which shows the contribution of each process variable included in the model to the SPE or HT statistics and the process variables with a high contribution are identified as the most likely to cause the alarm. Such traditional contribution plots, however, may suffer from a huge number of process variables involved in the MPCA model calculation and not suitable for caster start-up operation monitoring. For example, in one preferred embodiment, a total of 62 process variables are selected and the trajectory of each variable in the start cast duration is synchronized based on the predetermined synchronization scales, which results in up to 800 observations for each selected variable. Hence, a total of 49600 model inputs will contribute to SPE or HT statistics. The contribution plots of such a great number of model inputs won't provide the helpful information to operators.

However, the nature of these model inputs may inherently be categorized into three groups:

past values of process variables that describe the process changes in the past period, i.e., from the beginning of the start cast duration to the current time;

current values of process variables that describe the current situation of start-up operation;

predicted values of process variables that forecast how the start-up operation will evolve in the future based on the assumptions described at 150 (FIG. 11).

In fact, when an alarm is generated, the only thing operators can do to intervene and to avoid the actual occurrence of the predicted start cast breakout is to change the current process operations. Therefore, the root cause needs to be identified only for the current observations. Furthermore, if a certain process variable has a high contribution to SPE or HT in all normal start-up operations in the modeling set, it can also be expected to have a high contribution in a new start-up operation. However, if an alarm is generated when a new start-up operation is monitored, and a certain process variable has a higher contribution than what it usually has in the normal start-up operations, it probably is the most likely root cause to this alarm. As the control limits of SPE and HT contributions have been calculated at 74 (FIG. 3) in step 158 (FIG. 11) of a preferred embodiment of this invention, the most likely root causes to a generated alarm are identified as the process variables that have the highest ratio of the SPE or HT contribution at the current observation to its corresponding control limit.

Update Control Limits

In this invention, the control limits of SPE, HT statistics and the contributions of process variables to SPE and HT statistics provide the confidence intervals to determine whether a start-up operation, or a certain process variable, is under its normal operation region. Such control limits are calculated based on a large number of historical operation data, instead of some known probability distribution functions in theory. Although the selected historical data are expected to span as much of a normal operation region as possible, they cannot cover the entire operation region due to the limited size of available historical data. Furthermore, the normal operation region may drift from where it currently is as time goes by. All these issues may lead to the calculated control limits at the time when a model is built to lead to a number of false or failed alarm because the model does not represent the current normal operation.

One feature developed for this invention is to automatically update these control limits at 162 (FIG. 11) based on the latest available start-up operation data to partially compensate for the possible normal operation region drift not captured by the current control limits. The method of online updating the control limits at 162 is described as follows in detail.

Once the SPE and HT statistics at the end of the start cast duration becomes available, which implies no start cast breakout has occurred in the current operation, they are examined to check if they are within the corresponding control limits. If either the SPE or HT statistic is beyond its current control limit, then no control limit update is performed based on this start-up operation; otherwise, the control limits of the SPE, HT statistic and the contributions are updated based on the following calculations. In the text below, the HT statistic is taken as an example, and the same method can be applied to SPE statistic and the contributions to SPE and HT statistics. The updated control limit of HT at a certain observation is calculated by:

$$CL_{new}=(1-a)*CL_{cur}+a*\{CL_{cur}+r*|HT-CL_{cur}|/(HT-CL_{cur})*d\}$$

where HT is the calculated HT statistic at the given observation in the start cast duration; $CL_{cur}$ and $CL_{new}$ are the current and updated control limit of HT at this observation, respectively; the parameter a is set to 60%; the parameter r is equal to 95%, if $HT>CL_{cur}$; or 5%, if $HT<CL_{cur}$; and the parameter d is determined from the historical data as follows:

suppose a sequence q contains the HT statistics at the given observation for all start-up operations in the modeling set, and all HT statistics in q are ranked in an ascending order; define another sequence qdif to calculate the difference of every two adjacent elements of q as:

$$q\text{dif}=[q(2)-q(1),\ q(3)-q(2),\ \ldots,\ q(m)-q(m-1)]$$

and then d is calculated as the mean value of the sequence qdif.

INDUSTRIAL APPLICABILITY

The realization of a caster start-up operation online monitoring system using multivariable statistical models of the process requires the availability of the process measurements described above to a computer system. The computer system is used to perform MPCA calculations to predict an impending start cast breakout. A realization of said system is currently in operation.

The multivariable statistical models are developed offline based on the selected historical data using MPCA technology. The models are validated by evaluating the false alarm rate, failed alarm rate and the lead-time to breakout before it can be applied online, in real-time.

Although this invention has been described with reference of predicting start cast breakouts of a continuous caster, it is not limited thereto. In particular, this invention can be applied to predict the breakouts occurring in the other caster operations such as SEN change, flying tundish change, plate insert and so on. It will be understood that several variants may be made to the above-described embodiment of the invention, within the scope of the appended claims.

The invention claimed is:

1. A method for monitoring the operation of a continuous caster in a start-up casting mode in which molten metal is shaped in a continuous caster to form a solidifying strand product before the continuous caster reaches a predetermined minimum caster speed, the method including the following steps:

retrieving historical data consisting of multiple historical observations of process variables for a plurality of continuous caster start-up operations, the number of historical observations varying from one continuous caster start-up operation to another;

selecting a modelling set from said historical data to represent normal start-up operations of a continuous caster;

creating a synchronized data set of process trajectories from said modelling set in which the number of historical observations from each continuous caster start-up operation is scaled to correspond to a selected length of strand product;

performing a multi-way principal component analysis (MPCA) on said synchronized data set to calculate the value of principal components T and a loading matrix P for each continuous caster start-up operation to develop a multivariate statistical model of normal continuous caster start-up operations;

computing test statistics selected from the group consisting of Squared Prediction Error (SPE) and "Hotelling T" (HT) for each observation from said multivariate statistical model;

selecting control limits for said SPE and HT test statistics and their contributions;

acquiring on-line data consisting of multiple observations of said process variables observed at an elapsed time t during a start-up operation of a continuous caster;

predicting future process trajectories for said on-line data for a start-up operation of the continuous caster producing said selected length of strand product, historical data and on-line data being selected to correspond to a start-up operation having a casting speed of at least 0.1 meter/second;

applying said multivariate statistical model to a matrix $X_{new}$ of said future process trajectories to compute test statistics selected from the group consisting of Squared Prediction Error (SPE) and "Hotelling T" (HT);

comparing said test statistics computed from the matrix $X_{new}$ to the said control limits; and generating a detection signal, said detection signal being indicative of whether the continuous caster start-up operation is consistent with normal start-up operations in a continuous caster.

2. A method according to claim 1 in which the historical data and on-line data are selected to correspond to a start-up operation having a cast length of strand product of up to 3.2 meters.

3. A method according to claim 1 in which the process variables are selected from the group comprising: mold thermocouple readings, temperature differences between pre-defined thermocouple pairs, stopper rod postion, tundish car net weight, mold cooling water flows, temperature difference between inlet and outlet mold cooling water, casting speed, and calculated heat flux transferred through each mold face.

4. A method according to claim 1 in which synchronization of process trajectories is based on non-uniform scales in the selected strand length whereby the MPCA calculation is performed more frequently at the beginning of a start-cast operation than at the end of the start-cast operation.

5. A method according to claim 4 in which the start-cast operation is selected to begin at a casting speed of 0.1 meter/second and to end at a casting length of 3.2 meters.

6. A method according to claim 1 in which the control limits are selected to exclude 5% of the continuous casting operations which represent normal start-up operations.

7. A method according to claim 1 in which the contribution of each process variable to SPE or HT at each observation in the strand length is calculated and control limits are selected to exclude 5% of the continuous casting operations which represent normal start-up operations.

8. A method according to claim 1 in which a number of multivariate statistical models are developed each corresponding to a range of continuous caster operating conditions selected from the group comprising: grade of metal being cast and width of casting strand.

9. A method according to claim 1 in which an alarm is generated to indicate an impending start-cast breakout or abnormal situation if the SPE or HT statistic of a new start-up operation exceeds its control limit over 3 consecutive sampling intervals.

10. A method according to claim 1 in which process variables are identified as the most likely causes of abnormal behaviour based on their contributions to the SPE and HT statistics.

11. A method according to claim 10 in which the likely root causes of abnormal behaviour are identified as the process variables that have the highest ratio of the SPE or HT contribution at a current observation and at a corresponding control limit.

12. A method according to claim 1 in which the control limits of SPE, HT and their contributions are updated from current operational data.

13. A method according to claim 1 in which future process trajectories are predicted based on the assumption that future deviations from average trajectories for process variables in the historical observations will remain constant.

14. A method according to claim 1 in which synchronization of process trajectories is based on non-uniform scales in the selected strand length whereby the MPCA calculation is performed more frequently at the beginning of a start-cast operation than at the end of the stad-cast operation.

15. A method according to claim 14 in which the start-cast operation is selected to begin at a casting speed of 0.1 meter/second and to end at a casting length of 3.2 meters.

16. A method for monitoring a start-up operation of a continuous caster which begins with pouring liquid steel into an empty mould and ends when a cast length of strand product reaches a pre-determined length, the method including the following steps:

retrieving historical data consisting of multiple historical observations of process variables for a plurality of continuous caster start-up operations which begin with pouring liquid steel into an empty mould and end when a cast length of strand product reaches a pre-determined length, the number of historical observations varying from one continuous caster start-up operation to another, selecting a modelling set from said historical date to represent normal start-up operations of a continuous caster, creating a synchronized data set of process trajectories from said modelling set in which the number of historical observations from each continuous caster start-up operation is scaled to correspond to a selected length of strand product;

performing a multi-way principal component analysis (MPCA) on said synchronized data set to calculate the value of principal components T and a loading matrix P for each continuous caster start-up operation to develop a multivariate statistical model of normal continuous caster start-up operations;

computing test statistics selected from the group consisting of Squared Prediction Error (SPE) and "Hotelling T" (HT) for each observation from said multivariate statistical model;

selecting control limits for said SPE and HT test statistics and their contributions;

acquiring on-line data consisting of multiple observations of said process variables observed at an elapsed time t during a start-up operation of a continuous caster;

predicting future process trajectories for said on-line data for a start-up operation of the continuous caster producing said selected length of strand product;

applying said multivariate statistical model to a matrix $X_{new}$ of said future process trajectories to compute test statistics selected from the group consisting of Squared Prediction Error (SPE) and "Hotelling T"(HT);

comparing said test statistics computed from the matrix $X_{new}$ to the said control limits; and generating a detection signal, said detection signal being indicative of whether the continuous caster start-up operation is consistent with normal start-up operations in a continuous caster.

17. A method according to claim 16 in which the historical data and on-line data are selected to correspond to a start-up operation having a casting speed of at least 0.1 meter/second.

18. A method according to claim 17 in which the historical data and on-line data are selected to correspond to a start-up operation having a cast length of strand product of up to 3.2 meters.

19. A method according to claim 1 in which the process variables are selected from the group comprising: mold thermocouple readings, temperature differences between pre-defined thermocouple pairs, stopper rod postion, tundish car net weight, mold cooling water flows, temperature difference between inlet and outlet mold cooling water, casting speed, and calculated beat flux transferred through each mold face.

20. A method according to claim 16 in which the control limits are selected to exclude 5% of the continuous casting operations which represent normal start-up operations.

21. A method according to claim 16 in which the contribution of each process variable to SPE or HT at each observation in the strand length is calculated and control limits are selected to exclude 5% of the continuous casting operations which represent normal start-up operations.

22. A method according to claim 16 in which a number of multivariate statistical models are developed each corresponding to a range of continuous caster operating conditions selected from the group comprising: grade of metal being cast and width of casting strand.

23. A method according to claim 16 in which an alarm is generated to indicate an impending start-cast breakout or abnormal situation if the SPE or HT statistic of a new start-up operation exceeds its control limit over 3 consecutive sampling intervals.

24. A method according to claim 16 in which process variables are identified as the mast likely causes of abnormal behaviour based on their contributions to the SPE and HT statistics.

25. A method according to claim 24 in which the likely root causes of abnormal behaviour are identified as the process variables that have the highest ratio of the SPE or HT contribution at a current observation and at a corresponding control limit.

26. A method according to claim 16 in which the control limits of SPE, HT and their contributions are updated from current operational data.

27. A method according to claim 16 in which future process trajectories are predicted based on the assumption that future deviations from average trajectories for process variables in the historical observations will remain constant.

* * * * *